US009216425B2

(12) United States Patent
Ojea

(10) Patent No.: US 9,216,425 B2
(45) Date of Patent: Dec. 22, 2015

(54) FUNNEL SHAPED SHOWER SHIELD AND KIDDIE SHOWER

(71) Applicant: Anthony Jason Ojea, Reading, PA (US)

(72) Inventor: Anthony Jason Ojea, Reading, PA (US)

( * ) Notice: Subject to any disclaimer, the term of this patent is extended or adjusted under 35 U.S.C. 154(b) by 194 days.

(21) Appl. No.: 13/779,669

(22) Filed: Feb. 27, 2013

(65) Prior Publication Data

US 2013/0219613 A1 Aug. 29, 2013

Related U.S. Application Data

(60) Provisional application No. 61/603,901, filed on Feb. 27, 2012.

(51) Int. Cl.

| | |
|---|---|
| ***A47K 3/00*** | (2006.01) |
| ***B05B 1/18*** | (2006.01) |
| ***B05B 1/26*** | (2006.01) |
| ***E03C 1/086*** | (2006.01) |

(52) U.S. Cl.
CPC ... *B05B 1/18* (2013.01); *B05B 1/26* (2013.01); *E03C 1/086* (2013.01)

(58) Field of Classification Search
USPC ..... 239/500, 505, 499; 4/615, 601, 605; 248/316.8
See application file for complete search history.

(56) References Cited

U.S. PATENT DOCUMENTS

| | | | | |
|---|---|---|---|---|
| 2,900,139 | A * | 8/1959 | Hensley, Jr. | 239/499 |
| 3,465,968 | A * | 9/1969 | Halpern | 239/504 |
| 4,821,960 | A | 4/1989 | Goldman | |
| 5,967,201 | A * | 10/1999 | Gasior | 141/98 |
| 6,357,710 | B1 * | 3/2002 | Fielden et al. | 248/276.1 |
| D501,040 | S | 1/2005 | Gieson et al. | |
| D612,492 | S | 3/2010 | Krumins | |
| 7,937,784 | B2 | 5/2011 | Qiu | |
| D639,383 | S | 6/2011 | Holbrook | |

* cited by examiner

*Primary Examiner* — Lauren Crane

(57) ABSTRACT

A shower attachment acts as a shield to block a child from the encompassing high pressure water spraying from an ordinary shower head. The shower attachment also acts as a kiddie shower that imitates the spraying action of an ordinary bathroom showerhead. The shield portion can include a funnel shape that allows the blocked water from the shower head to flow down through the shower attachment and then exit in a spraying fashion that is less frightening to children. The shower attachment includes a clamping mechanism to attach to a conventional shower arm, a funnel-shaped shield and shower, and extender bars interconnecting the clamping mechanism with the funnel-shaped shield and shower. The extender bars can be rotated to position the funnel-shaped shield and shower in front of the shower head to catch water being expelled therefrom.

6 Claims, 4 Drawing Sheets

FUNNEL SHAPED SHOWER SHIELD AND KIDDIE SHOWER

CROSS-REFERENCE TO RELATED APPLICATION

This application claims the benefit of priority of U.S. provisional application No. 61/603,901, filed Feb. 27, 2012, the contents of which are herein incorporated by reference.

BACKGROUND OF THE INVENTION

The present invention relates to shower accessories and, more particularly, to a child's themed funnel shaped shower shield and kiddie shower.

As a parent, one responsibility is to educate one's children on how to maintain and regain bodily cleanliness. Over the years, the parent demonstrates several techniques and strategies to their children on how to regain bodily cleanliness from head to toe. Children often have mixed emotions to these new experiences. Some tasks children find fun and exciting; while other tasks can be considered annoying, intimidating or even frightening.

The transition from bathing to showering can be a frightening or uncomfortable experience for children, resulting in a difficult transition. It is often frightening for children to make the change from bathing in calm, still water in a bathtub, to showering beneath a loud, adult-height shower head that is spraying out encompassing, high pressure water. Unfortunately, as children grow up, this is an unavoidable practice they must learn to feel comfortable performing.

Currently, there are only a few solutions to this problem. These products fall into one of two categories. The first type is expensive devices that require disassembly of one's current household bathroom shower head, only then to reassemble to their shower head the additional pieces from the new device. Additional, this type of device often requires the use and purchase of a particular tool to complete the installation. If a person is not familiar with the steps required to perform the installation, the instructions can be quite confusing and frustrating. These products can then become very time consuming to install. One example of these "assembly required" attachments is the hand-held sprayer. This product is not only time consuming to install, but then the parent must find a means to store the hose and sprayer when they are not in use. Another drawback arises when the product is no longer needed, because it then has to be uninstalled.

The other types of products on the market are not as expensive or as time consuming to install as the "assembly required" products. However, these products fail to eliminate all the fear factors incurred by children new to showering. An example of this type of product is a fish-shaped showerhead cover which slips over the shower head, giving it a more child-friendly appearance. This particular product does nothing to eliminate the other intimidating factors a child new to showering will experience, such as a loud, extremely high above shower head that is spraying out encompassing, high pressure water at them.

As can be seen, there is a need for a shower accessory that may ease a child's showering fear, increase their comfort showering, and be easy to attach and detach.

SUMMARY OF THE INVENTION

In one aspect of the present invention, a shower attachment comprises a clamping mechanism fitting on a shower arm; first and second arms extending from the clamping mechanism; a shield device attached to and supported by ends of the first and second arms; a funnel extension extending from a front side of the shield device, wherein water exiting a shower head is direct to a back side of the shield device and is received into the funnel extension to exit a distal end thereof.

In another aspect of the present invention, a shower attachment comprises a clamping mechanism fitting on a shower arm, the clamping mechanism including clamp fingers resiliently separated by squeezing clamp handles; first and second arms extending from the clamping mechanism, the first and second arms extending from the clamping mechanism with an adjustable angle; a shield device attached to and supported by ends of the first and second arms, the shield device sized and positionable to block the flow of water expelled from a shower head; a funnel extension extending from a front side of the shield device, wherein water exiting the shower head is direct to a back side of the shield device and is received into the funnel extension to exit a distal end thereof.

These and other features, aspects and advantages of the present invention will become better understood with reference to the following drawings, description and claims.

DETAILED DESCRIPTION OF THE INVENTION

Figure 1:
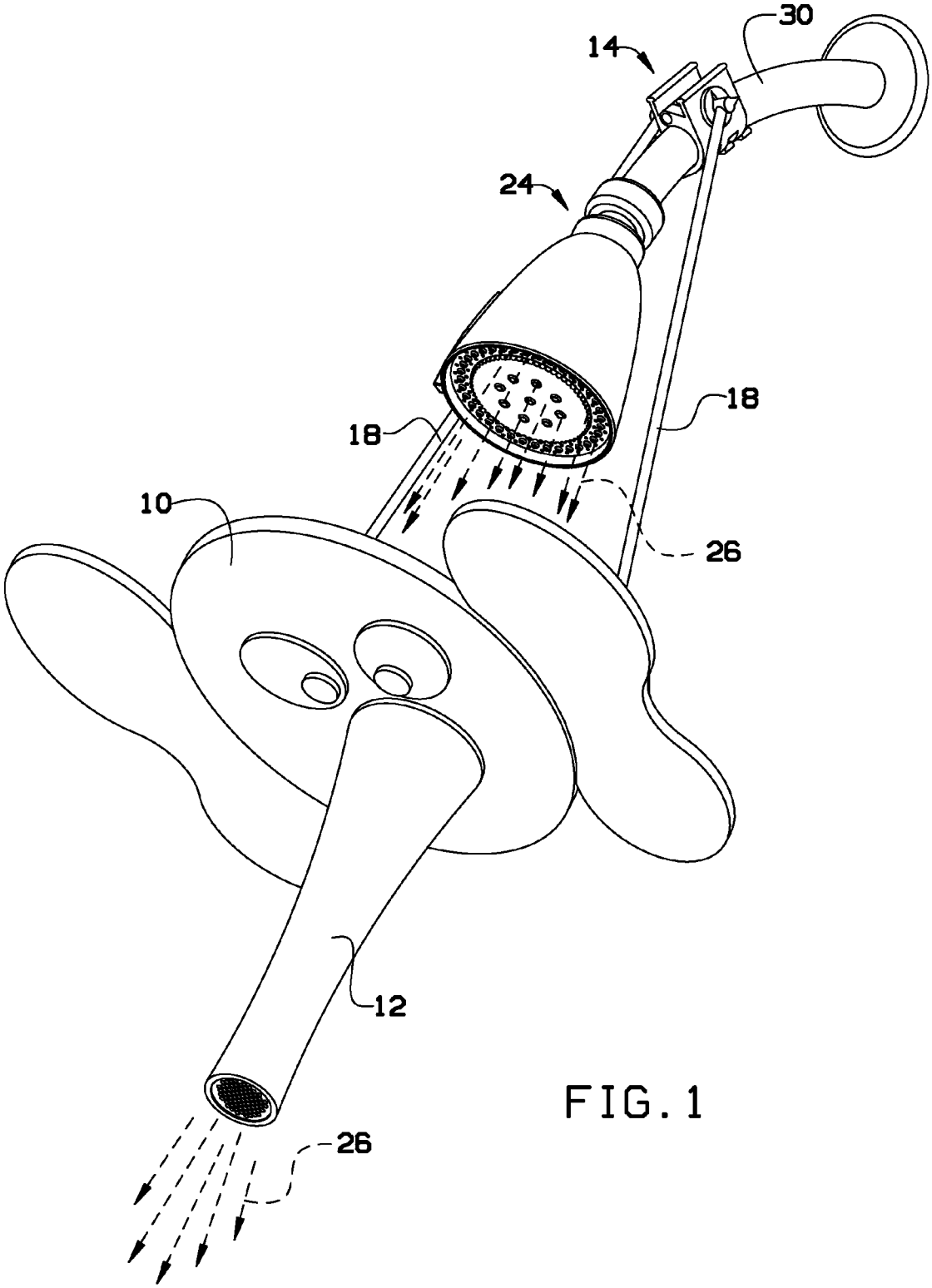
FIG. 1 is a front perspective view of a shower device according to an exemplary embodiment of the present invention.
Figure 2:
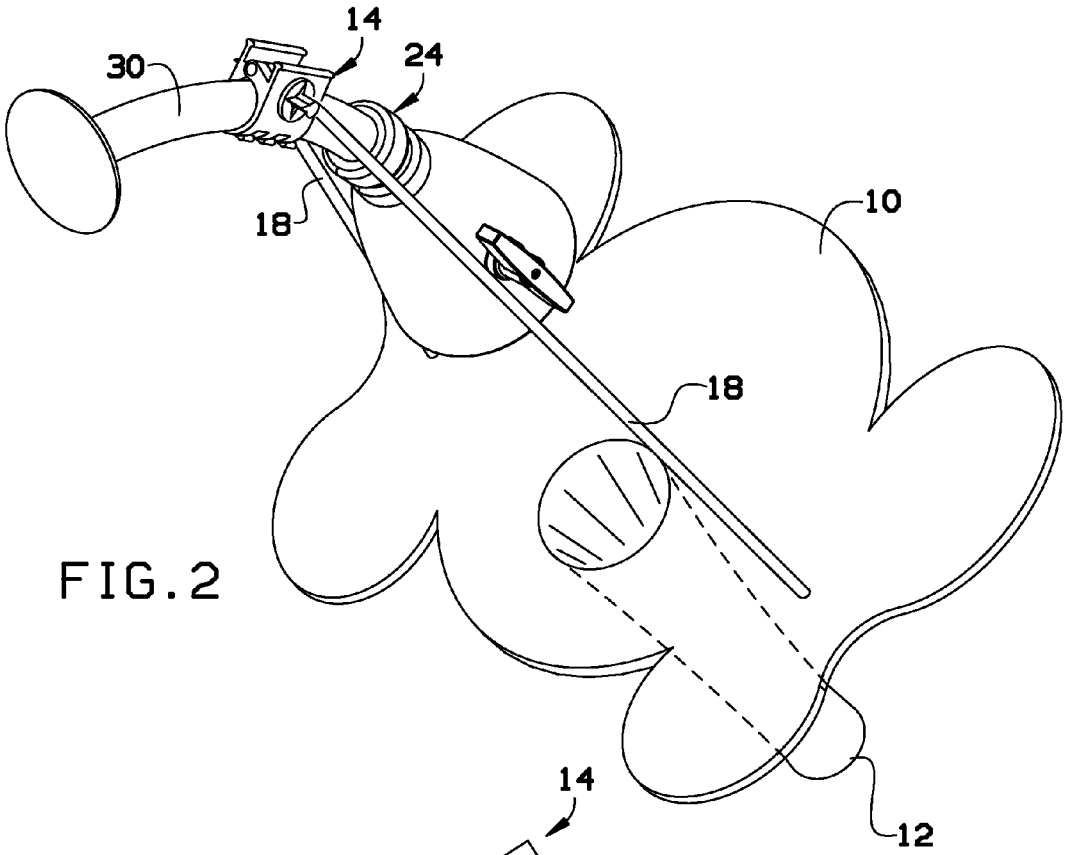
FIG. 2 is a rear perspective view of the shower device of FIG. 1.
Figure 3:
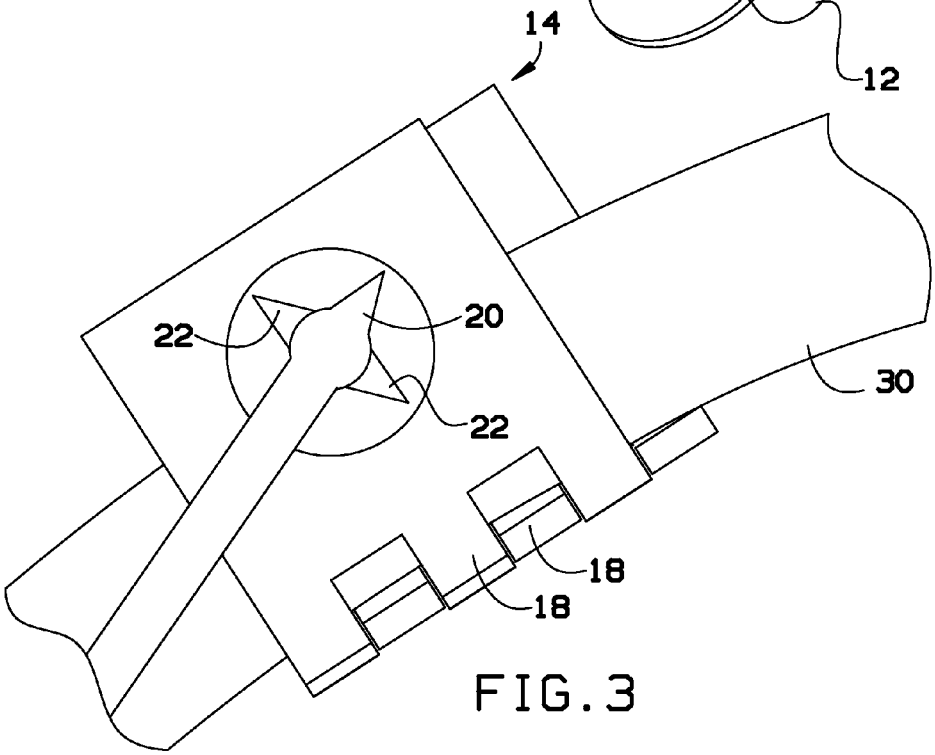
FIG. 3 is a detailed side view of a clamp of the shower device of FIG. 1.
Figure 4:
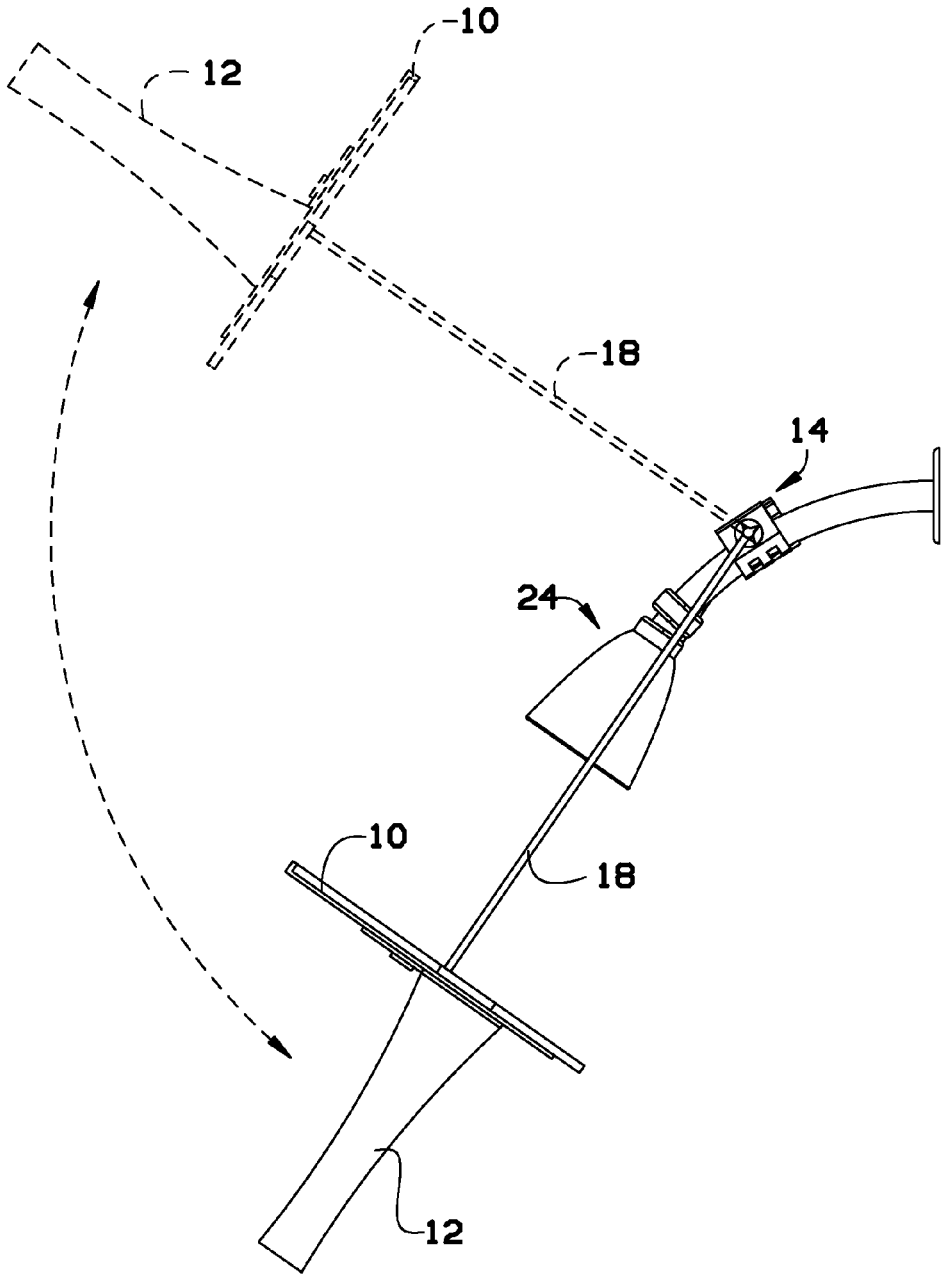
FIG. 4 is a side view of the shower device of FIG. 1, illustrating a range of adjustable motion thereof.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a shower attachment that acts as a shield to block a child from the encompassing high pressure water spraying from an ordinary shower head. The shower attachment also acts as a kiddie shower that imitates the spraying action of an ordinary bathroom showerhead. The shield portion can include a funnel shape that allows the blocked water from the shower head to flow down through the shower attachment and then exit in a spraying fashion that is less frightening to children. The shower attachment includes a clamping mechanism to attach to a conventional shower arm, a funnel-shaped shield and shower, and extender bars interconnecting the clamping mechanism with the funnel-shaped shield and shower. The extender bars can be rotated to position the funnel-shaped shield and shower in front of the shower head to catch water being expelled therefrom. The water can then exit through multiple smaller front side openings in a fashion that imitates the spraying action of a real bathroom's shower head.

With the shower attachment of the present invention, the spraying water exits the funnel-shaped shield and shower at a location closer to the child showering and exits typically with significantly less pressure (water exits simply due to gravity and the force of water in the funnel-shaped shield) than a conventional shower head.

Referring now to FIGS. 1 through 6, a shower attachment includes a shield device 10 having a funnel extension 12 extending from a front side thereof. The shield device 10 is open where the funnel extension 12 attaches, thereby permitting water 26 exiting a shower head 24 to impinge upon the shield device 10, pass into the funnel extension 12 and flow out of the funnel extension 12 at an end distal to the attachment of the funnel extension 12 to the shield device 10. The opening to permit water to pass into the funnel extension 12 can be from about 7 to about 10 inches in diameter, for example. The funnel extension 12 can be from about 2 to 4 inches in diameter and from about 5 to 10 inches long.

Should some water from the shower head 24 miss this opening, it can simply drip off the shield device 10, creating a drip or low pressure water stream from the bottom of the shield device. In some embodiments, the shield device 10 can be shaped to provide a path for water to drain off the back of the shield device (either from missed spray or overflow from the funnel extension 12, for example). This path can be designed, for example, to provide a gentle waterfall-like flow off the back of the shield device 10.

The shield device 10 includes arms 18 extending from a rear side thereof. The arms 18 terminate at a clamping mechanism 14 that is operable to clamp on a shower arm 30. The arms 18 can be sized to properly position the shield device 10 and the funnel extension 12 at an ideal location for a particular child. In some embodiments, the arms 18 can be from about 8 to about 10 inches in length. In some embodiments, the arms 18 can be adjustable arms to permit a user to adjust its length.

Figure 5:
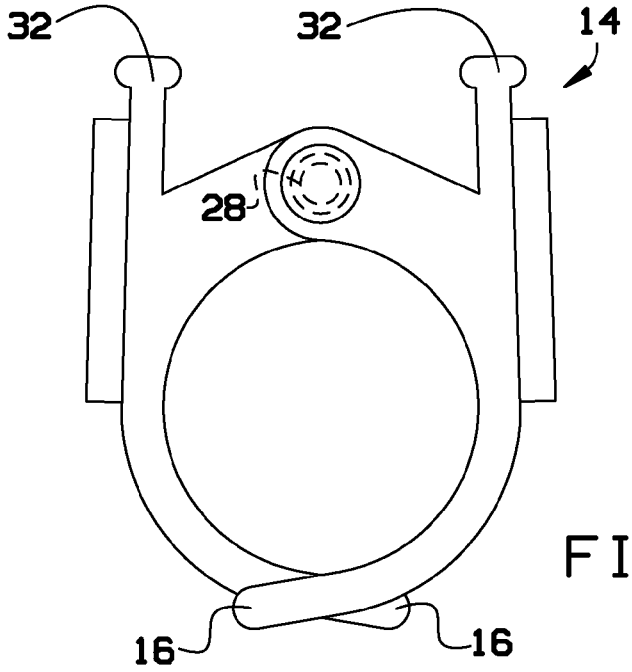
FIG. 5 is an end view of a clamp of the shower device of FIG. 1, in a closed configuration.
Figure 6:
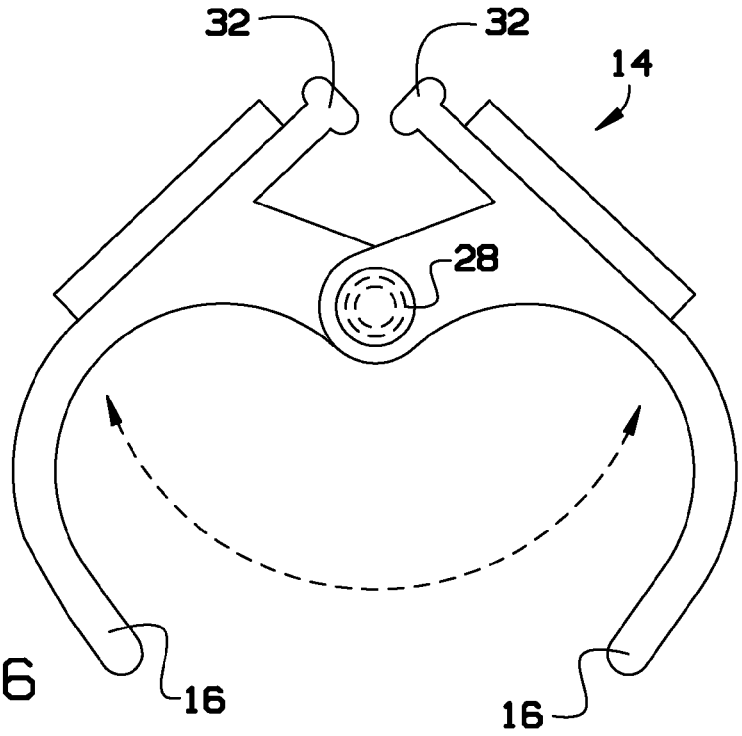
FIG. 6 is an end view of the clamp of FIG. 5, in an open configuration.

The clamping mechanism 14 can be made in various manners. One example of a clamping mechanism is shown in the Figures and described below. The clamping mechanism 14 can include a pair of spring-loaded fingers 16 that are resiliently retained closed (as shown in FIG. 5) by a spring mechanism 28. A user can squeeze clamp handles 32 to cause the fingers 16 to open (as shown in FIG. 6), allowing placement over the shower arm 30. In some embodiments, the fingers 16 can be coated with an anti-slip material to help the clamping mechanism 14 be secured to the shower arm 30.

In some embodiments, the clamping mechanism 14 can include a plurality of clamp lock notches 22. The arms 18 can include an arm lock tooth 20 at its end that connects to the clamping mechanism 14. The arm lock tooth 20 can fit into one of the clamp lock notches 22. The clamp lock notches 22 can provide for height adjustment of the shield device 10 to account for different heights of children. The clamp lock notches 22 can also allow the shower device to be positioned out of the way so an adult can shower without having to remove and store the shower device.

While the Figures show the shield device in an elephant shape and design, other designs are contemplated within the scope of the present invention. For example, the shield device can be shaped in any number of child-friendly designs.

While the Figures (see FIG. 4, for example) show the shield device 10 as a generally planar component, the shield device 10 could be curved to urge water to pass into the funnel extension 12, or, as discussed above, to permit overflow and/or overspray to flow off the back of the shield device 10.

To use the shower attachment, a user can simply attach the clamping mechanism 14 to the shower arm 30 and direct the shower head 24 to expel water onto the shield device 10 in the vicinity of the funnel extension 12. The water can then pass through the funnel extension 12 to be released gently out of holes formed in the end of the funnel extension 12.

It should be understood, of course, that the foregoing relates to exemplary embodiments of the invention and that modifications may be made without departing from the spirit and scope of the invention as set forth in the following claims.

What is claimed is:

1. A shower attachment comprising:

a clamping mechanism fitting on a shower arm, the clamping mechanism including clamp fingers resiliently separated by squeezing clamp handles, wherein the clamping mechanism includes a spring mechanism to resiliently close the clamp fingers together in a closed configuration;

first and second arms extending from the clamping mechanism;

a shield device attached to and supported by ends of the first and second arms;

a funnel extension extending from a front side of the shield device;

a plurality of clamp lock notches disposed on sides of the clamping mechanism;

an arm lock tooth formed in an attachment end of the first and second arms, wherein the arm lock tooth fits into one of the plurality of clamp lock notches to provide adjustment of the position of the shield device, and wherein water exiting a shower head is direct to a back side of the shield device and is received into the funnel extension to exit a distal end thereof.

2. The shower attachment of claim 1, wherein the shield device has a size that prevents water expelled from the shower head from passing around the shield device.

3. The shower attachment of claim 1, wherein the arms are from about 8 to about 10 inches in length and the funnel attachment is from about 5 to about 10 inches in length.

4. A shower attachment comprising:

a clamping mechanism fitting on a shower arm, the clamping mechanism including clamp fingers resiliently separated by squeezing clamp handles, wherein the clamping mechanism includes a spring mechanism to resiliently close the clamp fingers together in a closed configuration;

first and second arms extending from the clamping mechanism, the first and second arms extending from the clamping mechanism with an adjustable angle;

a shield device attached to and supported by ends of the first and second arms, the shield device sized and positionable to block the flow of water expelled from a shower head;

a plurality of clamp lock notches disposed on sides of the clamping mechanism;

an arm lock tooth formed in an attachment end of the first and second arms, wherein the arm lock tooth fits into one of the plurality of clamp lock notches to provide adjustment of the position of the shield device; and a funnel extension extending from a front side of the shield device, wherein water exiting the shower head is direct to a back side of the shield device and is received into the funnel extension to exit a distal end thereof.

5. The shower attachment of claim 4, wherein the arms are from about 8 to about 10 inches in length and the funnel attachment is from about 5 to about 10 inches in length.

6. The shower attachment of claim 4, wherein the shield device has a size that prevents water expelled from the shower head from passing around the shield device.

* * * * *